US005907111A

United States Patent [19]

Josten et al.

[11] Patent Number: 5,907,111

[45] Date of Patent: May 25, 1999

[54] REMOTELY CONTROLLED SENSOR APPARATUS FOR USE IN DIG-FACE CHARACTERIZATION SYSTEM

[75] Inventors: Nicholas E. Josten; John M. Svoboda, both of Idaho Falls, Id.

[73] Assignee: Lockheed Martin Idaho Technologies Company, Idaho Falls, Id.

[21] Appl. No.: 08/841,973

[22] Filed: Apr. 8, 1997

[51] Int. Cl.[6] ..... F14H 11/16

[52] U.S. Cl. ..... 73/866.5

[58] Field of Search ..... 73/866.5, 865.8, 73/105; 250/253, 255

[56] References Cited

U.S. PATENT DOCUMENTS

| | | | |
|---|---|---|---|
| 4,973,970 | 11/1990 | Reeser | 342/357 |
| 5,025,150 | 6/1991 | Oldham et al. | 73/866.5 |
| 5,452,639 | 9/1995 | Aulenbacher et al. . | |

OTHER PUBLICATIONS

Josten, N. E., *Technical Evaluation Report*, "Progress on Development of the Dig–face Characterization Technology," Apr. 1995, Idaho National Engineering Laboratory, INEL–95/0093, pp. A–3 thru A–18.

Josten, N. E., et al, Dig–face Monitoring during Excavation of a Radioactive Plume at Mound Laboratory, Ohio, Dec. 1995, Idaho National Engineering Laboratory, INEL–95/0633.

*Primary Examiner*—Robert Raevis
*Attorney, Agent, or Firm*—Workman Nydegger & Seeley

[57] ABSTRACT

A remotely controlled sensor platform apparatus useful in a dig-face characterization system is deployed from a mobile delivery device such as standard heavy construction equipment. The sensor apparatus is designed to stabilize sensors against extraneous motions induced by heavy equipment manipulations or other outside influences, and includes a terrain sensing and sensor elevation control system to maintain the sensors in close ground proximity. The deployed sensor apparatus is particularly useful in collecting data in work environments where human access is difficult due to the presence of hazardous conditions, rough terrain, or other circumstances that prevent efficient data collection by conventional methods. Such work environments include hazardous waste sites, unexploded ordnance sites, or construction sites. Data collection in these environments by utilizing the deployed sensor apparatus is desirable in order to protect human health and safety, or to assist in planning daily operations to increase efficiency.

54 Claims, 11 Drawing Sheets

REMOTELY CONTROLLED SENSOR APPARATUS FOR USE IN DIG-FACE CHARACTERIZATION SYSTEM

CONTRACTUAL ORIGIN

The United States Government has rights in this invention pursuant to contract number DE-AC07-94ID13223 between the U.S. Department of Energy and Lockheed Martin Idaho Technologies Company.

BACKGROUND OF THE INVENTION

FIELD OF INVENTION

The present invention relates to a system for monitoring excavation sites in order to improve the safety and efficiency of hazardous waste retrieval or other excavation activities. More particularly, the present invention relates to a remotely controlled sensor apparatus suited for deployment from standard heavy equipment and used in a dig-face characterization system.

RELEVANT TECHNOLOGY

Excavation monitoring is the practice of making periodic sensor measurements to evaluate certain conditions as they change during the course of an excavation such as at a construction site or hazardous waste site. Such monitoring can be effective whenever there is some type of sensor measurement that can be useful to the operation. Useful sensor measurements can include ground site topography (grade) mapping, buried solid object detection, hazardous materials detection, moisture content measurement, etc. In conventional practice, workers carrying hand-held sensors make these measurements if they are made at all.

Formalized sensor monitoring has been shown to be particularly valuable during excavation of hazardous waste sites. Appropriate sensor data collected over the ground surface within the excavation provide the earliest possible warning of imminent hazards and are also useful for assessing progress and planning future activities. Also, knowledge of changing conditions creates a basis for many efficiency improvements in a construction-type operation.

One of the principle environmental problems associated with buried hazardous waste (e.g., radiological, chemical, or explosive) is that the toxic materials and contaminants found in a buried waste pit are not uniformly distributed. Much of the toxic material and contamination in buried waste pits is concentrated in small, though randomly located portions of the overall waste pit. According to new Environmental Protection Agency (EPA) standards, it is a common practice for hazardous materials in buried waste pits to be removed to an isolated storage or treatment location.

Sensors have been developed which can isolate radiological, chemical, explosive, or other toxic and hazardous materials by passing the sensors over the surface of the overburden of the waste pit. The sensors typically detect toxic materials within about 6 inches of the surface although radiological materials can be detected at a greater distance. In any event, it is known to pass a sensor-carrying cart over the surface of a buried waste pit and to thus monitor the location of concentrated hazardous waste. A sensor-carrying trolley has also been used, which can be managed by more than one person to expand the area of deployment. However, both the cart and the trolley are limited to flat and very small areas only. For large deposits, a sensor-carrying gantry crane has been used, which is a large inverted U-shaped crane typically made of steel that moves back and forth on concrete-supported rails.

In using the sensor-carrying cart, trolley, or gantry crane, the data is collected and sent to a remote station where it is analyzed and mapped. Thereafter, an earthmover is used to remove six inches of the overburden. The removed overburden will permit the most toxic materials to be sent off-site, and that which is insufficiently toxic to exceed the EPA limit is retained on-site. A further problem is that the reliability of the results are directly related to the uniformity of height of the sensors above the ground surface. If the sensors are not at all times about 6 inches above the ground, the readings will not be as reliable. Variations of height of the sensors above the ground surface are, however, inherent in prior devices for all non-level buried waste pits.

Furthermore, previous approaches to sensor deployment over large, rugged areas or hostile environments have been developed without concern for adaptability to different environments. Excavation monitoring has been accomplished at a small hazardous waste site using a motorized three-axis trolley to deploy sensors in and around the excavation. Similar approaches have been proposed for large hazardous waste sites, but the equipment to deploy the sensors has been highly specialized and is not adaptable to different sites. It has also been suggested that robotic vehicles could be used to deploy sensors over excavation sites. This approach, however, would be expensive, could result in contamination of the vehicle, and is limited to sites with moderate terrain.

Inadequate knowledge of potential hazards during waste retrieval can promise worker safety or lead to spreading or mixing of hazardous materials. Thus, there is a need for an improved system and method for monitoring excavation activities such as during hazardous waste retrieval operations.

SUMMARY AND OBJECTS OF THE INVENTION

The present invention is a remotely controlled sensor apparatus suitable for deployment from a mobile delivery device and useful in a dig-face characterization system. The sensor apparatus comprises a platform assembly, a sensor attached to the platform assembly, and means for vertically adjusting the elevation of the sensor over terrain. The sensor apparatus also includes means for stabilizing the sensor against extraneous motions induced by manipulation of the mobile delivery device or other outside influences, and means for sensing terrain and providing sensor elevation control to maintain the sensor in close ground proximity.

The sensor used in the invention can be selected from a variety of sensor devices such as a geophysical sensor, a chemical sensor, a radiological sensor, an explosives sensor, or various combinations thereof. In one embodiment, the vertically adjusting means for the sensor is an extendible mast such as an electric linear actuator. A data acquisition and control system is attached to the platform assembly and operatively communicates with the sensor.

In one embodiment, the means for stabilizing the sensor comprises a first yoke member providing dampened rotation of the platform assembly about a first horizontal axis, and a second yoke member providing dampened rotation of the platform assembly about a second horizontal axis perpendicular to the first horizontal axis. The first and second yoke members are interconnected through a yoke linkage. The means for stabilizing the sensor also preferably includes a stabilization system to eliminate pendulum oscillations about the first and second yoke members. The stabilization system can include passive devices such as a damper or active devices such as a motor.

The means for sensing terrain and providing sensor elevation control is preferably a terrain following system operatively attached to the sensor apparatus. The terrain following system senses terrain and provides sensor elevation control to maintain the sensor in close ground proximity by utilizing the following method. A sensor is moved across uneven terrain in a predetermined path, and the position and/or velocity of the sensor is updated at regular time intervals to subdivide the sensor path into a series of segments. The terrain topography around the sensor is mapped continuously, and a target elevation for the sensor is set based on the most recent topography data each time the sensor position is updated and a new path segment is begun. The height of the sensor is adjusted at a rate required to achieve the target elevation by the end of the path segment to maintain a substantially constant terrain clearance as the sensor is moved across the terrain.

A system for deploying the remotely controlled sensor apparatus according to the present invention and used in a dig-face characterization operation includes a mobile delivery device, and the sensor apparatus detachably coupled to the mobile delivery device. The sensor apparatus is preferably rigidly coupled to the mobile delivery device by a quick-connect member protruding from the platform assembly and engaging a complimentary coupling member on a boom of the mobile delivery device. The mobile delivery device is preferably an excavator, such as a backhoe, a crane, or a power shovel, in which the bucket has been detached and replaced with the sensor apparatus.

In a method for deploying the remotely controlled sensor apparatus of the invention in a dig-face characterization operation, a mobile delivery device such as an excavator is provided and the sensor apparatus is coupled to the mobile delivery device as described above. The mobile delivery device is positioned in a predetermined location, and the sensor is then used to scan the location. The sensor scan is preferably accomplished by swinging the sensor back and forth through a series of concentric arcs over the scan area. Data from the sensor scan area is relayed to a workstation computer, and real time information on subsurface conditions within the scan area is displayed.

The present invention is particularly useful in collecting data in work environments where human access is difficult due to the presence of hazardous conditions, rough terrain, or other circumstances that prevent efficient data collection by conventional methods. Such work environments include hazardous waste sites, unexploded ordnance sites, or construction sites. Data collection in these environments is desirable in order to protect human health and safety, or to assist in planning daily operations to increase efficiency. The present system is advantageous in that it connects to standard heavy construction equipment and is consequently suitable for use in any environment that can accommodate such construction equipment.

Accordingly, a principle object of the present invention is to provide a system for remotely deploying sensors in order to improve the safety and efficiency of hazardous waste retrieval or other excavation activities.

An additional object of the invention is to provide a portable apparatus that can control a variety of sensors in order to precisely measure, display, and record the location, intensity, and distribution of contaminants.

A further object of the invention is to provide a sensor apparatus which is deployed by standard heavy equipment and is capable of working in rugged, hostile environments.

Another object of the invention is to provide a sensor apparatus that permits real time monitoring of toxic waste and hazardous material concentrations in buried waste pits. Additional objects and features of the invention will become more fully apparent from the following description and appended claims, or may be learned by the practice of the invention as set forth hereafter.

BRIEF DESCRIPTION OF THE DRAWINGS

In order to more fully understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE INVENTION

Figure 1:
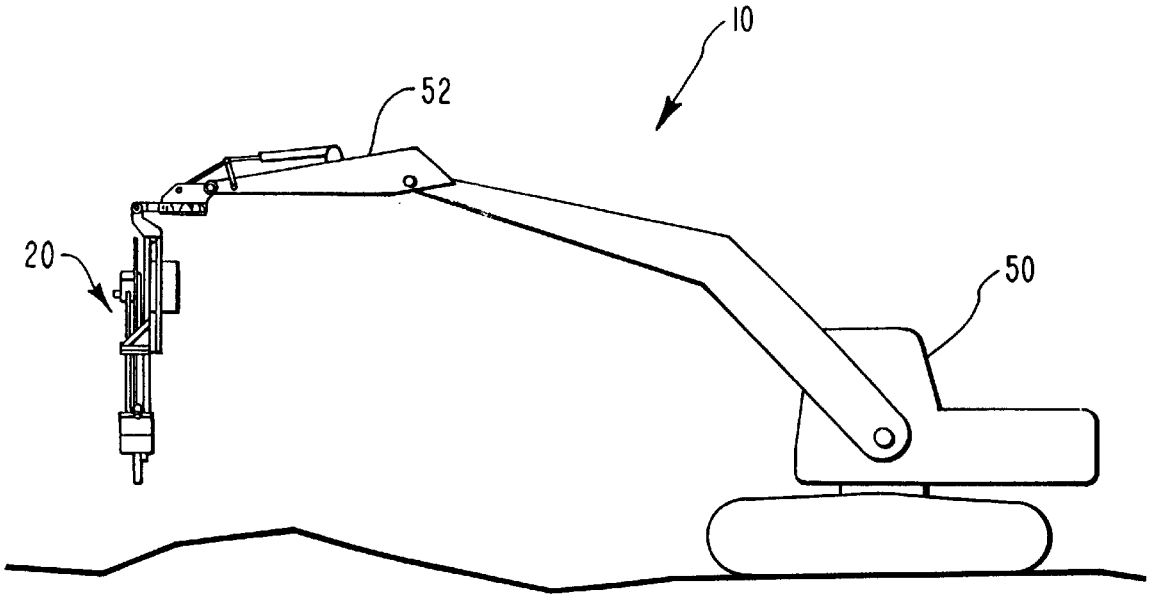
FIG. 1 is a schematic side view of a first embodiment of the remote sensor apparatus deployed from a mobile delivery device according to the present invention.

The present invention is a remotely controlled sensor platform apparatus suited for deployment from standard heavy equipment. The invention provides the capability to remotely deploy specialized sensors using standard heavy equipment such as an excavator as the primary deployment mechanism. The remote sensor apparatus is specifically designed to collect data in environments where human access is difficult due to the presence of hazardous conditions, rough terrain, or other circumstances that prevent efficient data collection by conventional methods.

Examples of such work environments include hazardous waste sites, unexploded ordnance sites, or construction sites. Data collection in these environments is desirable in order to protect human health and safety or to assist in planning daily operations to increase efficiency.

The sensor platform apparatus of the invention and system for deployment thereof is particularly useful in a dig-face characterization operation, and offers a near universal solution to deploying a wide variety of sensors within any sized excavation. The system for deploying the sensor apparatus includes a mobile delivery device, with the sensor apparatus demountably coupled to the mobile delivery device. The mobile delivery device is preferably an excavator, such as a backhoe, a crane, or a power shovel, in which the sensor apparatus detached and replaced with the sensor apparatus. Use of a backhoe is particularly preferred since it is more versatile in various applications, decreases health and safety issues, and is less costly to operate.

The invention allows sensors to be scanned over large ground areas in virtually any terrain, while providing fine motion adjustment internally. Through use of position tracking equipment, sensor data acquisition equipment, a display screen located inside the heavy equipment operator's cab, and a radio frequency network that links these elements together, high precision data may be acquired anywhere without requiring human entry into the excavation.

Dig-face characterization is a technique that has been developed for improving the safety and efficiency of hazardous waste retrieval. The dig-face characterization system includes on-site sensors and hardware for collecting detailed information on the changing chemical, radiological, and physical conditions in the subsurface during the entire course of hazardous site excavation. The measurement capability of the dig-face characterization system sets up an interplay between hazard detection activities and excavation activities, such that new information is constantly collected to guide the digging process.

The dig-face characterization system functions to monitor and identify changing conditions during waste excavation in order to avoid the undesirable consequences of incomplete knowledge of potential hazards. Site managers use information retrieved from the system to recognize and guide potentially dangerous operations. The dig-face characterization system assists remediators by monitoring and identifying toxic and radioactive hazards, and by providing information on the subsurface distribution of solid objects. Detection of hazards falls primarily into the category of chemical (including nuclear) analysis methods. Some hazards, such as gamma-ray emitters or volatile organics, may be addressed as a group with multipurpose sensors. Other hazardous substances require very specific sensors or may not be detectable at all.

The detection of solid objects is performed using geophysical sensors, which define the physical (rather than chemical) characteristics of the subsurface. Common objectives of solid object detection include delineating boundaries of solid waste, determining depth to waste, and locating individual objects or groups of objects. This information establishes continually improving guidelines on the size of the site, presence and location of waste-free areas, and provides a basis for recognizing boundaries between different types of waste.

A system for deploying the remote sensor apparatus of the invention in a dig-face characterization operation is shown schematically in FIG. 1. A mobile sensor system 10 includes a mobile delivery device such as an excavator 50 with an attached boom 52, and a sensor apparatus 20 detachably coupled to boom 52. As discussed in greater detail below, the design of sensor apparatus 20 stabilizes the sensors thereon, maintains proper sensor orientation in a vertical plane, and makes fine adjustments of sensor elevation so that high quality measurements can be made. The mobility of sensor system 10 allows for more flexibility in the use thereof at various sites compared to prior systems.

Figure 2:
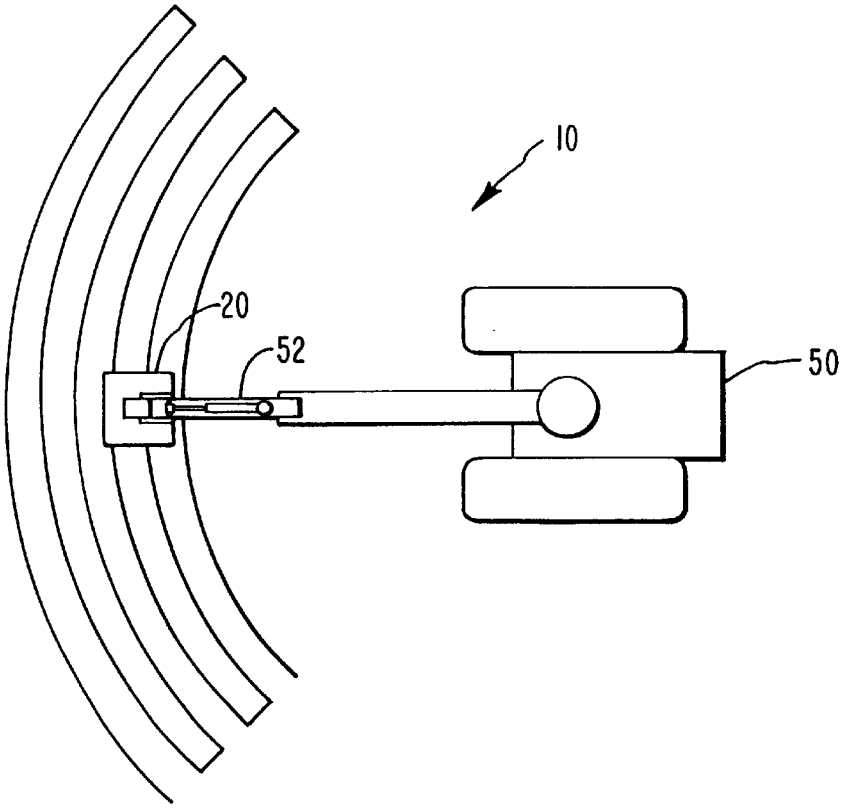
FIG. 2 is a schematic plan view of the sensor apparatus and mobile delivery device shown in FIG. 1, indicating the arc-shaped movement of the sensor apparatus.

The mobile sensor system 10 is operated easily by a trained equipment operator. The remote sensor platform operator defines an area of interest based on consultation with site managers. The area of interest is then displayed on the excavator operator display console in the cab of excavator 50 along with a graphical indicator showing the position of excavator 50. The excavator operator identifies the area of interest using the display console in the cab of excavator 50. As depicted in FIG. 2, once excavator 50 has been positioned in a predetermined location, the location is scanned by swinging sensor apparatus 20 back and forth through a series of long arcs over the target scan area using boom 52. Arc radius is adjusted at the end of each swing to produce a scan pattern that appears as a set of concentric arcs as shown in FIG. 2. The sensor apparatus may move briefly out of a vertical orientation in response to accelerations of the excavator, but quickly returns to vertical when the accelerations stop.

By this method, a typical mobile delivery device such as excavator 50 can scan approximately 1000 square feet of terrain per 90° of arc. It is estimated that high density data (about 1 ft by 2 ft) can be collected over such an area in approximately 10 to 15 minutes, so that mobile sensor system 10 is highly efficient. Data from the sensor scan area is positioned stamped and downloaded to a computer at a main remote workstation via radio link and displayed in real time, giving immediate information on subsurface conditions within the scan area.

At the end of the scan, the sensor apparatus is disconnected and the excavator bucket is reconnected to the excavator for normal operations. For example, when the sensor determines that hazardous waste is below EPA limits, the sensor apparatus is detached from the excavator and the earth is removed the required distance and preserved on-site. On the other hand, when highly toxic material is discovered, the sensor apparatus is detached and the excavator is utilized to remove and place the toxic material into appropriate containers for transportation off-site. The present invention thus provides a real time decision-making tool on whether to remove or not remove waste material from the site. Accordingly, only toxic waste which exceeds EPA limits has to be removed.

While being operated, the sensor apparatus of the invention does not contact the ground, thus avoiding problems with equipment contamination at hazardous sites. As discussed below, self-stabilizing and elevation adjustment features of the sensor apparatus permit operation in very difficult terrain, without degrading the sensor data quality. The sensor apparatus is relatively small and lightweight, thus making it portable. The portability feature of the sensor apparatus allows for easier shipment to a particular site and movement around the site. In addition, mostly conventional components are used in the sensor apparatus, resulting in a relatively low construction cost. The sensor apparatus can be constructed from a variety of materials such as aluminum, steel, plastic, fiberglass, or various combinations thereof.

Figure 3:
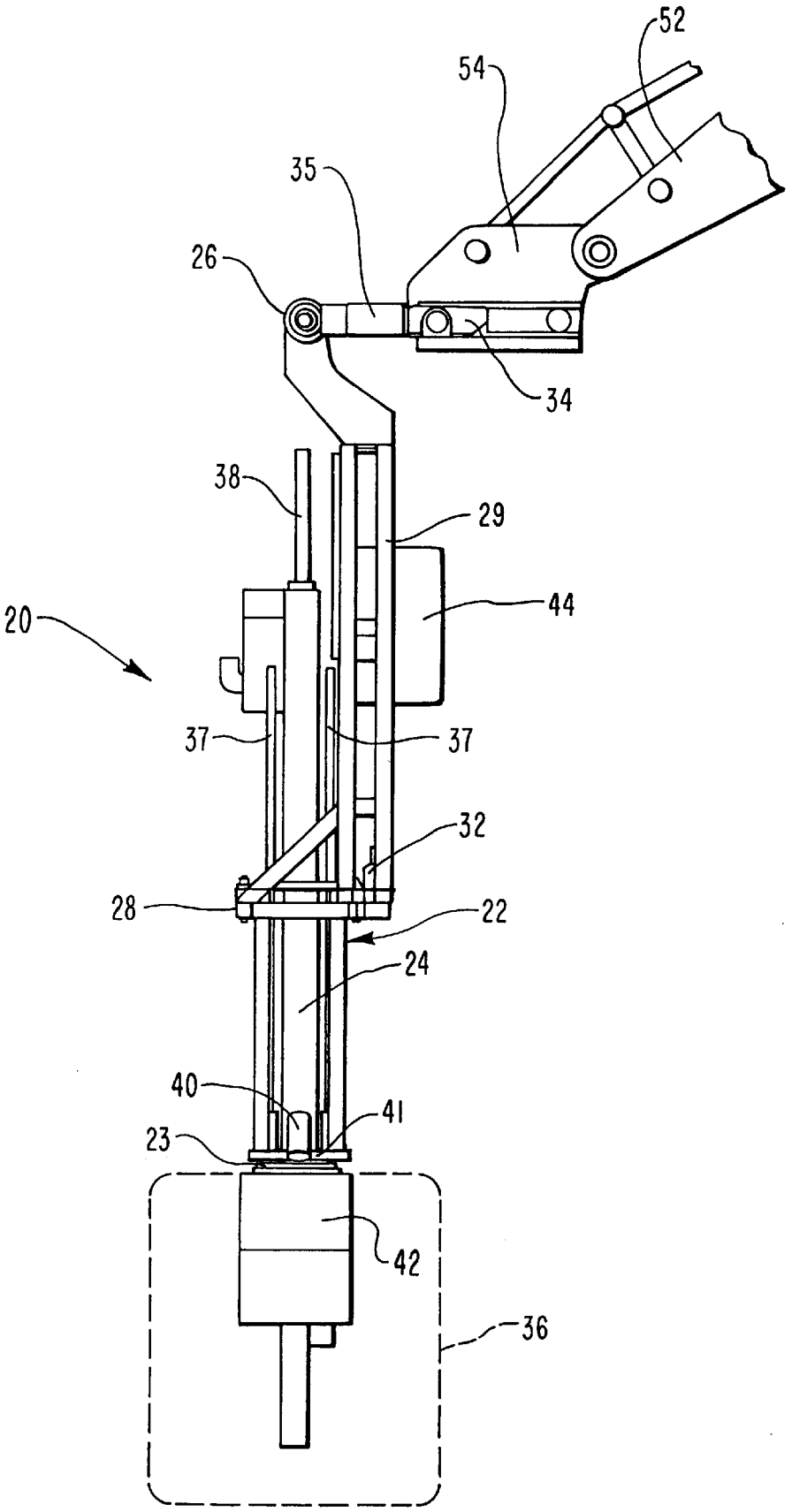
FIG. 3 is a side view of the first embodiment of the sensor apparatus of the invention, with a fully retracted mast.
Figure 4:
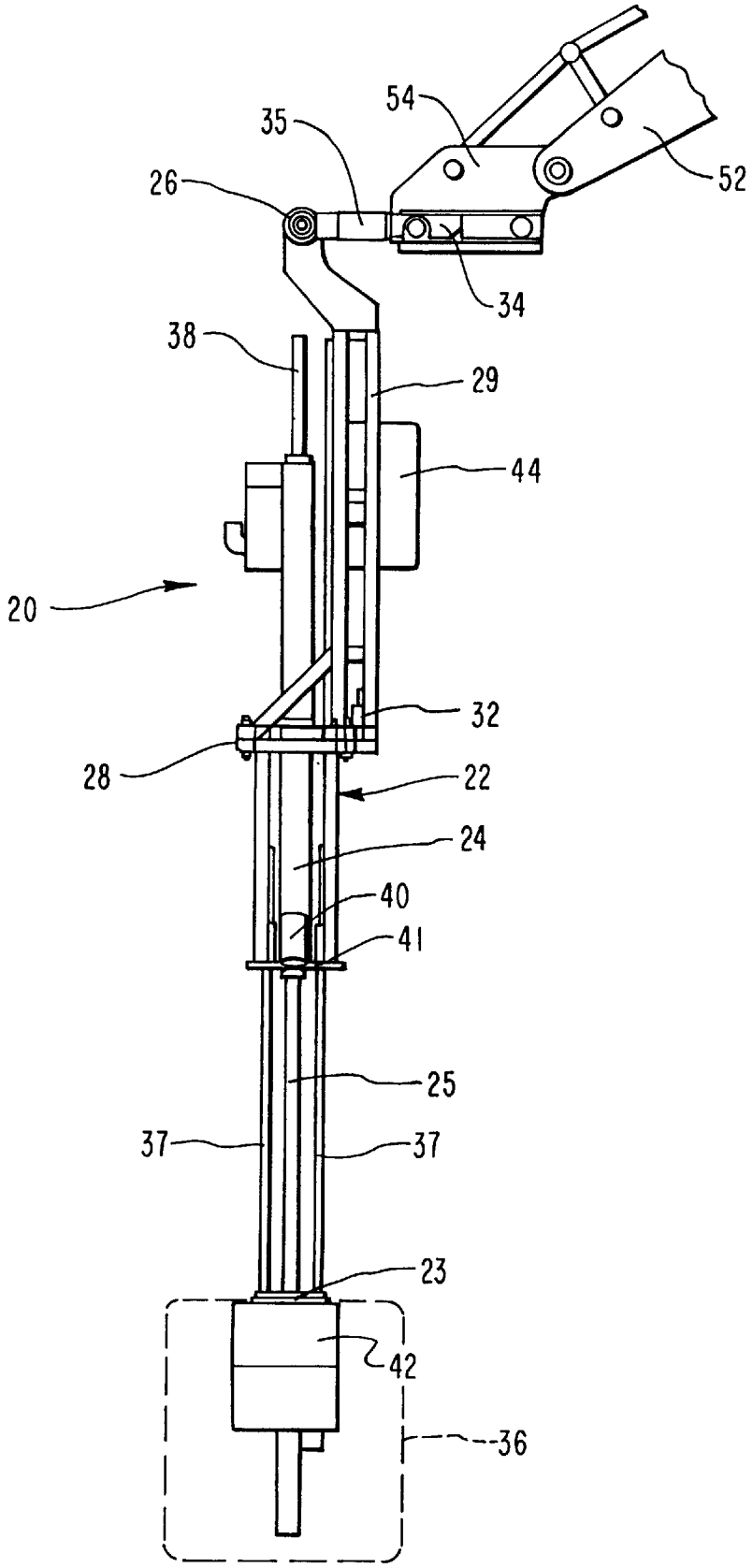
FIG. 4 is a side view of the sensor apparatus of FIG. 3, with an extended mast.
Figure 5:
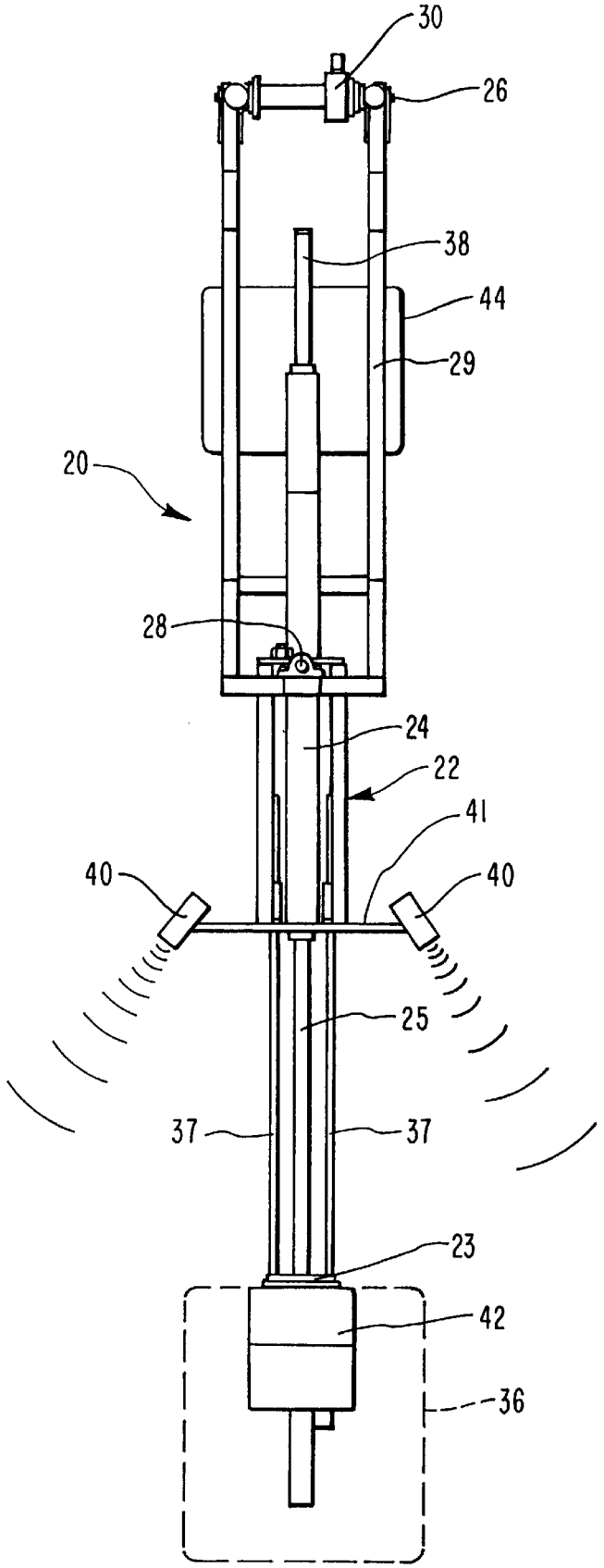
FIG. 5 is a front view of the sensor apparatus of FIG. 4.

The major components of the remote sensor apparatus of the invention according to a first embodiment are shown schematically in FIGS. 3–5. The sensor apparatus 20 includes a stable platform assembly 22, which connects rigidly to boom 52 of excavator 50. The position and method for attaching platform assembly 22 to excavator 50 is designed based on the need for optimum stability, minimum sensor deflection during excavator accelerations, and protection of the structure in case of accidental collision. FIGS. 3 and 4 show sensor apparatus 20 coupled to boom 52, while FIG. 5 depicts sensor apparatus 20 in a detached state. The platform assembly 22 is thus preferably built to accommodate easy connect and disconnect functions. Accordingly, a coupling means for detachably coupling platform assembly 22 to boom 52 is provided at a proximal end of sensor apparatus 20. A preferred embodiment of the coupling means includes a quick-connect member in the form of a connecting head 34 attached to a connecting member 35 protruding from a proximal end of platform assembly 22. The connecting head 34 couples with a complimentary coupling member 54 on boom 52. When disconnected from excavator 50, sensor apparatus 20 can be stored on a stand (not shown).

It will be appreciated that the coupling means can be implemented using various other equivalent structures and be within the intended scope of the invention. For example, various commercial quick-connect hardware components are available which can be implemented in the present invention.

Attached to platform assembly 22 is a means for vertically adjusting the elevation of the sensor over terrain. In the embodiment shown in FIGS. 3–5, such a vertically adjusting means for the sensor is in the form of an extendible mast 24 attached to platform assembly 22 and having a moveable extension rod 25. FIG. 3 depicts sensor apparatus 20 with mast 24 in a retracted position, while FIGS. 4 and 5 show mast 24 in an extended position. In a preferred embodiment, extendible mast 24 is an electric linear actuator.

It will be appreciated that the vertically adjusting means for the sensor can be implemented using various other equivalent structures and be within the intended scope of the invention. For example, in an alternative embodiment, the function of mast 24 can be accomplished by a robotic arm, which adds additional functional capabilities to platform assembly 22, such as lifting, manipulation of tools, etc.

As shown in FIGS. 3–5, an extendible sensor mount member 23 is movably engaged with platform assembly 22 and is attached to extension rod 25 of mast 24. The sensor mount member 23 is structured to accommodate a sensor mount area 36, depicted in FIGS. 3–5, where a sensor 42 can be mounted. The sensor mount member 23 includes a pair of vertical stabilizing rods 37 that move up and down as extension rod 25 is moved. Sensor mount area 36 preferably defines a cubic volume of about 3 ft by 3 ft by 3 ft. The sensor 42 is mounted on sensor mount member 23 within mount area 36 such that sensor 42 moves up or down as extension rod 25 of mast 24 is retracted or extended.

Extendible mast 24 thus provides vertical motion adjustment that allows sensor 42 to be raised or lowered to clear uneven terrain. Mast adjustment is also used for constant elevation scans when excavator tilt or other factors cause the sensor to deviate from the desired elevation. Mast movements are controlled based upon input from the external positioning system and/or the terrain following system discussed in further detail below, depending on whether the active scan is a constant elevation scan or a terrain following scan. A distance encoder tracks mast motions relative to the base of platform assembly 22.

The sensor apparatus 20 is designed to accommodate the requirement that mast 24 be maintained in a position close to vertical at all times in order to properly deploy the sensor. In addition, it is important to minimize sensor swing and protect the sensor apparatus from damage resulting from a collision. Thus, platform assembly 22 includes means for stabilizing the sensor against extraneous motions induced by manipulation of the mobile delivery device or other outside influences.

In the embodiment depicted in FIGS. 3–5, the stabilizing means for the sensor comprises a first yoke member 26 and a second yoke member 28 interconnected through a yoke linkage 29 of platform assembly 22. The first yoke member 26 provides dampened rotation of platform assembly 22 about a first horizontal axis. The second yoke member 28 provides dampened rotation of platform assembly 22 about a second horizontal axis perpendicular to and lower than the first horizontal axis. The yoke linkage 29 connecting first and second yoke members 26, 28 permits platform assembly 22 to rotate about two mutually perpendicular axes, one substantially perpendicular to boom 52 of excavator 50 and the other substantially parallel to boom 52. Rotation about these platform axes under the influence of gravity allows mast 24 to passively seek vertical at all times, regardless of excavator tractor tilting or boom geometry changes from extension or retraction thereof. The vertical separation of first and second yoke members 26, 28 allows sensor apparatus 20 to be less constricted in its movements with respect to excavator 50, since the structure of sensor apparatus 20 hangs below boom 52.

The rotation of platform assembly 22 about the platform axes can be controlled by a stabilization system to eliminate pendulum oscillations. Either a passive or active stabilization system can be used, which reduce the oscillational response of the sensor due to the combined effects of gravity, axial acceleration, and radial acceleration. The stabilization system preferably provides adjustable damping over a range of about plus (+) or minus (−) 45 degrees about the vertical, but releases when excessive torque is applied due to accidentally impacting a solid object. Both passive and active stabilization systems can provide field adjustable damping in order to tune the response of the stabilization system to acceleration for different sensor weights.

In the passive stabilization system, the restoring force applied to keep the sensor in a vertical position is gravity. The passive stabilization system can include either a fixed stabilizing device or a variable stabilizing device. Suitable fixed stabilizing devices for use in the passive system include constant non-adjustable friction dampers such as a linear, rotational or torsional damper. In one preferred embodiment, the stabilization system includes a passive device based on a rotational damper. When a linear damper is utilized, the linear damper acts on a moment arm that is attached to each of yoke members 26, 28. Suitable variable stabilizing devices include controllable/variable dampers such as a pulsed braking device or a slip clutch device. When a pulsed braking device is utilized, controlled variable damping is provided on the respective rotation axes where yoke members 26, 28 are located.

In the active stabilization system, the restoring force applied to keep the sensor in a vertical position is exerted by external power. Such power can be provided by a motor in a motor-driven stabilizer. The active stabilization system includes a vertical position sensor not affected by acceleration, torque producing devices such as a motor, and a control system to close the loop on vertical position control. During operation of the active stabilization system, the tilt (off vertical error) is detected by the vertical position sensor, amplified by the control system, and power is provided to the torque producing devices that counter any torque at the two yoke members attempting to rotate the sensor off vertical. Alternatively, the vertical position sensor is used in combination with radial encoders that measure the rotation of sensor apparatus 20 about the yoke axes. The vertical position sensor is used to set a vertical reference when the system is at rest and thereafter the radial encoders measure deviations from the vertical reference and feed an output to the control system so that power is provided to the torque producing devices as discussed above.

As shown in FIGS. 3–5, the stabilization system used with sensor apparatus 20 includes a first stabilizing device 30 operatively attached to yoke member 26, and a second stabilizing device 32 operatively attached to yoke member 28. The stabilization devices 30, 32 can be either passive stabilizing devices or active stabilizing devices. Various combinations of the above stabilizing devices can also be utilized with sensor apparatus 20. For example, different types of passive and/or active stabilizing devices could be used on each of yoke members 26, 28 in order to achieve a desired performance characteristic.

Figure 6:
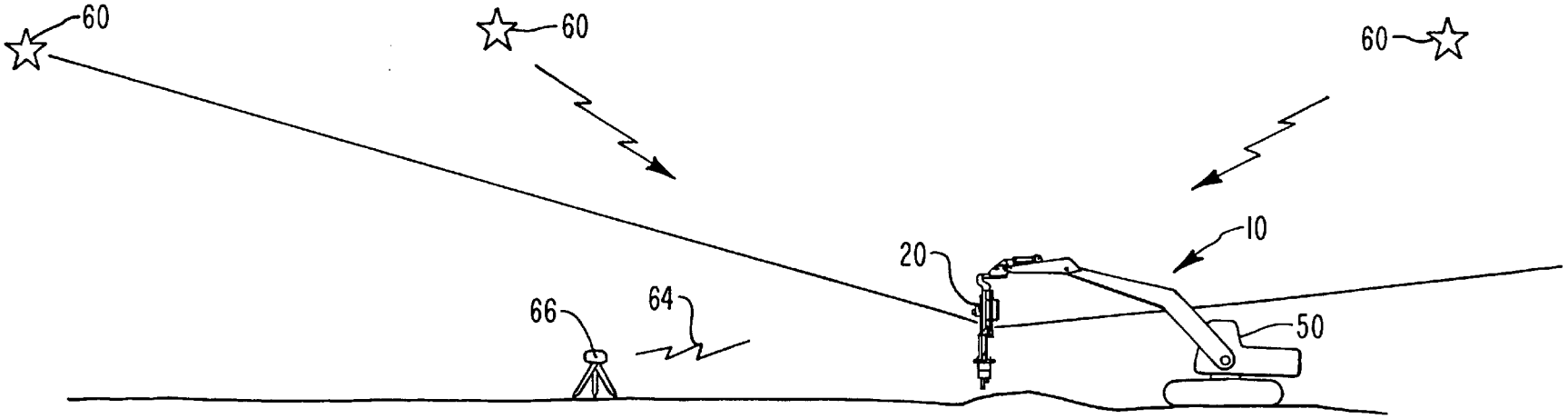
FIG. 6 is a schematic depiction of one embodiment of an external positioning system for use with the sensor apparatus of the invention.
Figure 7:
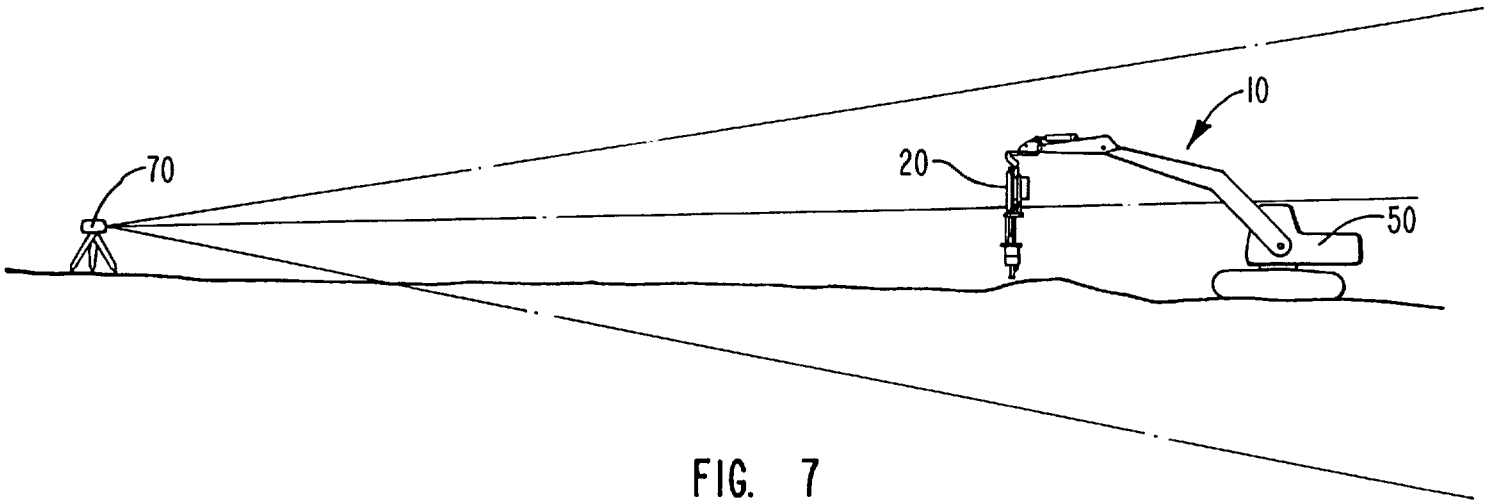
FIG. 7 is a schematic depiction of another embodiment of an external positioning system for use with the sensor apparatus of the invention.

An external positioning receiver 38 extends upwardly from mast 24 as depicted in FIGS. 3–5. The external positioning receiver 38 is utilized in an external positioning system to measure world coordinates for at least one to three points on platform assembly 22 at a rate of about one (1) to five (5) times per second. A coordinate transformation relation between the platform local coordinates and the site world coordinates can be developed based on these known points. This relation provides the basis for determining absolute position for each measurement taken during a sensor scan. Commercially available long-range, high-speed position tracking systems can be integrated into the system of the present invention to perform external positioning tasks. For example, a Global Positioning System (GPS) using orbiting satellites can be utilized for determining external position at outdoor excavation sites. A schematic depiction of the GPS for use in the present invention is shown in FIG. 6. There, mobile sensor system 10 receives positioning signals from a plurality of satellites 60. The mobile sensor system 10 also utilizes an RF link 64 to a base station 66 to transmit information received from satellites 60 to determine the position of mobile sensor system 10. Alternatively, a scanning laser positioning system can be used for both indoor and outdoor excavation sites. A schematic depiction of a scanning laser positioning system for use in the present invention is shown in FIG. 7. There, mobile sensor system 10 provides a laser target on sensor apparatus 20 for a scanning laser device 70 in order to determine the position of mobile sensor system 10. The external positioning receiver 38 can thus be a global positioning receiver or a scanning laser receiver depending on which positioning system is utilized with sensor apparatus 20.

The sensor apparatus 20 also includes means for sensing terrain and providing sensor elevation control to maintain the sensor in close ground proximity. Such a terrain sensing means is provided by a terrain following system 40 operatively attached to a platform member 41 of platform assembly 22 as shown in FIGS. 3–5. The terrain following system 40 can employ laser rangefinders and/or ultrasonic rangefinders. The following of terrain at a constant terrain clearance is highly desirable for certain types of sensors where signal strength improves dramatically at close range to provide the most accurate sensing. The terrain following system preferably utilizes a feedback system, which adjusts the Z-axis position of the sensor in a real time, ongoing basis. Thus, as platform assembly 22 is arcuately displaced across the surface of a buried waste pit, the sensor will move up and down instantaneously in accordance with the terrain, thus providing an immediately accurate real time view of toxic waste or hazardous material intensity.

The terrain following system provides the measurements and controls needed to adjust mast position to maintain a substantially constant terrain clearance as the sensor is scanned across uneven terrain. As the sensor is scanned across terrain, the position and/or velocity of the sensor is updated at regular time intervals by the external positioning system. These position update points subdivide the sensor path into a series of short segments, from about 0.2 to 1 ft apart. During the scan, terrain range finders continuously map topography around the sensor on all sides. Each time sensor position is updated and a new path segment is begun, a target elevation is set based on the most recent topography data. The sensor is then raised or lowered at the rate required to achieve the target elevation by the end of the path segment. In this manner, the terrain following system steps the sensor vertically as the excavator translates the sensor horizontally.

The terrain following system requires the capability to define the surface formed by the outer housing of the sensor and the terrain surface in a common coordinate system, requires that these two surfaces can be mathematically compared to determine if they intersect, and requires that intersection can be computed for a future position of the sensor, so that the sensor position can be adjusted to avoid collision. The surface formed by the outer housing of the sensor can be determined through measurement of the attitude and position of a measuring rod rigidly fixed with respect to the sensor. The ground surface can be defined by measurement of vector offset between the ground and a point of known position. If the point of known position is determined using the measuring rod, the ground surface will be defined in the same coordinate system as the sensor surface. The quality of ground surface definition depends on the number of offsets measured and their spatial distribution.

Figure 8:
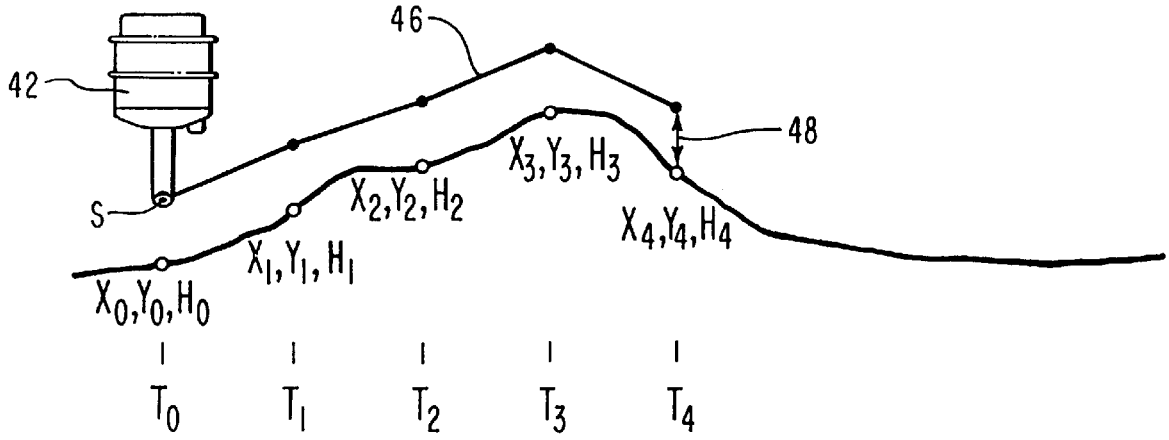
FIG. 8 is a schematic diagram of the operation of the terrain following system used in the sensor apparatus of the invention.

A schematic diagram of the operation of the terrain following system is shown in FIG. 8. A sensor 42 moves along a continuous path 46 that is subdivided into segments. The end points of each segment will normally correspond with points at which position is updated by the external positioning system. Thus, if position updates are established at regular time intervals ($\Delta T$), and the sensor moves with a constant velocity (V) along a straight path, each segment will have a length $V\Delta T$. Assuming V=1 ft per second and $\Delta T$=1 second, the fundamental segment length will be 1 ft. Considering a point S on sensor 42, if the terrain is accurately known along the path that point S will travel, the terrain following system can raise or lower sensor 42 to maintain the point S at a desired clearance height 48 above the terrain. Correct vertical motion of sensor 42 is achieved by establishing a target height for the sensor at the end of each segment. For example, if the sensor is at the point $X_0$, $Y_0$ at time $T_0$, it can be predicted that the sensor will be at a position $X_1$, $Y_1$ at time $T_1$. As the terrain height $H_1$ has been previously measured at position $X_1$, $Y_1$, the sensor can be instructed to be at this elevation plus clearance by the time the point S gets there. At $T_1$, the position is updated, a prediction is made for the position at time $T_2$, and the cycle is repeated.

It should be noted that the exact position of the sensor and the exact elevation of the sensor above the terrain are not actually known except at position update points. It is therefore imperative that the position be updated as often as possible and that good methods for predicting motion between update points be utilized. Changes in speed or direction due to excavator manipulations or other outside influences are potential problem areas. These might result from actions required to reposition the sensor at the end of each arc, attempts by the operator to provide coarse elevation adjustments when the terrain has more relief than can be accommodated by the mast, or miscellaneous incidents such as imperfect hydraulics, wind, or striking of the sensor against the ground. In addition, the terrain following system must stay ahead of the foremost sensor point S by at least 1 segment length. Thus, referring to the diagram of FIG. 8, the values for $X_2$, $Y_2$, and $H_2$ must be supplied as soon as the point S on sensor 42 reaches the point $X_1$, $Y_1$, $H_1$.

The terrain following system as described above involves construction of a localized topographic model at each moment of the scanning process, but only in the immediate vicinity of the sensor, with the sensor at the coordinate system origin. In another embodiment, it is also possible to employ global terrain mapping where terrain is first mapped over a large area and then the entire model is stored in a global coordinate system. During subsequent sensor scans, extendible mast control is directed based on the position of the sensor within the terrain model. This approach, however, requires very high-speed position tracking equipment and introduces an additional step into the data collection process. Furthermore, terrain measurements to feed the terrain following system can be made by sensors other than range finders. Mechanical "whiskers" that touch the ground can be used, as well as digital photogrammetric cameras.

Since the deployment of the sensor apparatus of the invention requires manual manipulations by the excavator operator, it will be necessary to communicate with the excavator during all active operations. The excavation operator's console facilitates this communication. The console includes a graphic display, a with the and a phone link with the main remote workstation. The primary graphical information is a site map showing the location of the excavator and the sensor in relation to ground landmarks. These enable the operator to move the excavator to a location and conduct a specific scan under direction of site managers. Audio signals are used to provide simple directions without requiring the operator to look away from the work at hand.

The remote platform operator at the main workstation transfers data acquisition commands to the excavator operator via the excavator's display console. These commands guide the excavator into the correct position and define the proper sequence of motions to complete a desired scan. The motions themselves are executed by the excavator operator such that the sensor is scanned over the surface being remediated. The console provides visual confirmation of the excavator's actual motions as compared with the desired motions. A radio network accommodates transfer of sensor data to the main workstation computer where data can be displayed and reviewed in real time. As waste retrieval proceeds, the sensor is continuously deployed to characterize the remaining waste. The remediation process thus proceeds in a step-wise manner in which the characterization data is interpreted on-line to support the retrieval process.

As shown in FIGS. 3–5, a data acquisition and control system 44 for the sensor apparatus 20 is attached to platform assembly 22. The control system 44 operatively communicates with sensor 42 and is radio linked to the main remote workstation. In addition, control system 44 is operatively connected to the terrain following system 40, to the external positioning receiver 38, and to a motor controlling extendible mast 24. The control system 44 also communicates with the excavator operator, and is operatively connected to the motor of an active stabilizing device when used. The remote workstation provides control functions for setting up each sensor scan, as well as for acquiring, archiving, and displaying radio network input from the sensor during the scan that is relayed through control system 44. The remote workstation can also provide post processing of sensor data as desired.

Figure 9:
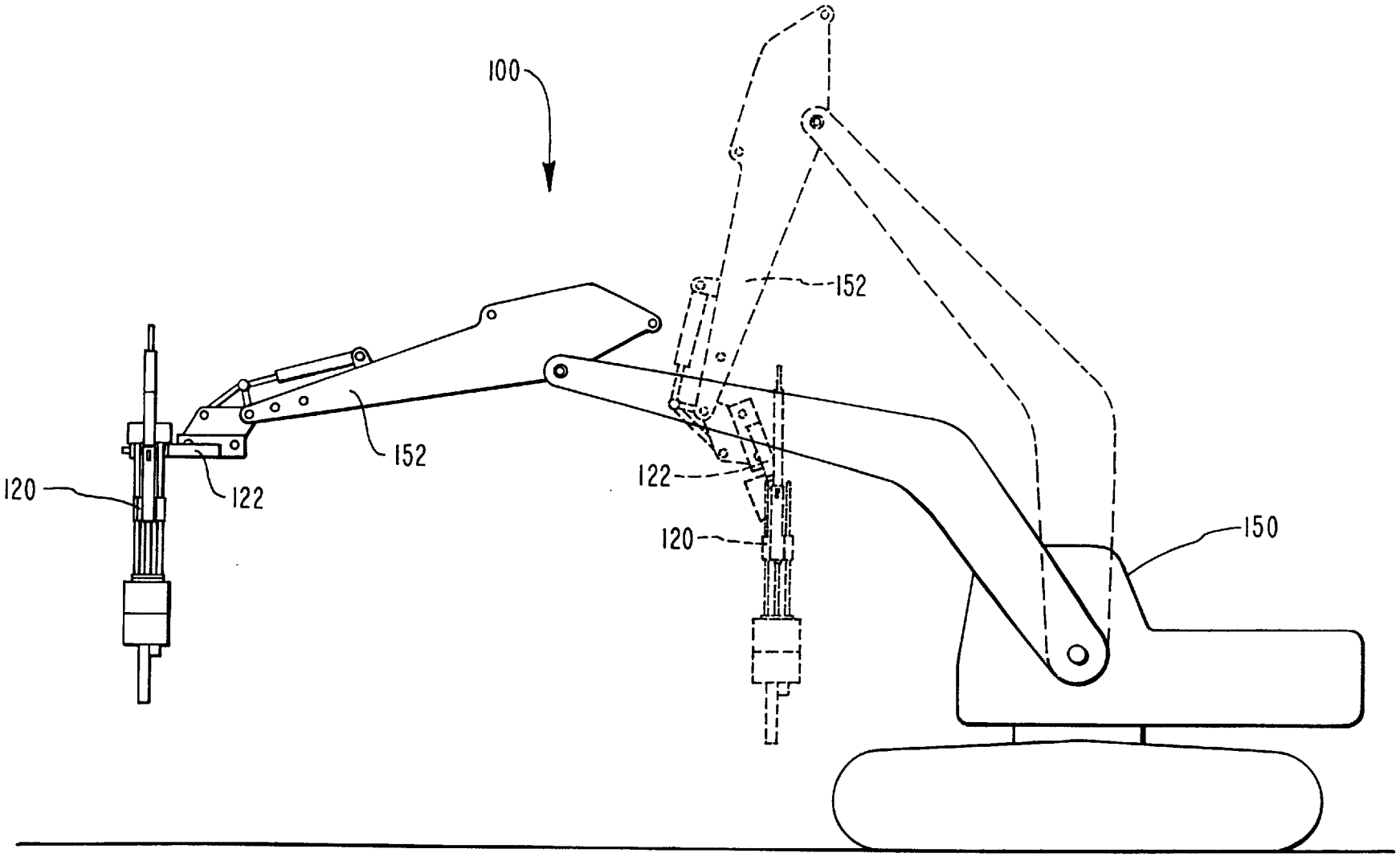
FIG. 9 is a schematic side view of a second embodiment of the sensor apparatus deployed from a mobile delivery device according to the present invention.

FIG. 9 is a schematic side view of a second embodiment of the sensor apparatus according to the present invention deployed from a mobile delivery device in a mobile sensor system 100. The mobile sensor system 100 includes an excavator 150 with an attached boom 152, and a sensor apparatus 120 detachably coupled to boom 152. As shown in FIG. 9, sensor apparatus 120 is constructed so as to maintain a substantially vertical orientation of the sensor as boom 152 is moved through varying angles.

Referring to FIGS. 10–13, various views of sensor apparatus 120 are shown in more detail. The sensor apparatus 120 is portable and provided with a stable platform assembly 122, which detachably couples to boom 152 of an excavator. A coupling means for detachably coupling platform assembly 122 to boom 152 is provided. A preferred embodiment of the coupling means includes a quick-connect member in the form of a connecting head 134 attached to a connecting member 135 of platform assembly 122 and engaging a complimentary coupling member 154 on boom 152. As shown in FIG. 9, platform assembly 122 is rigidly coupled to boom 152 such that platform assembly 122 rotates about a first horizontal axis perpendicular to boom 152 as boom 152 is moved through varying angles. Although connecting member 135 is shown in a straight configuration in FIG. 13, it should be understood that connecting member 135 can be modified into different configurations such as an L-shape or C-shape in order to alter the position of sensor apparatus 120 with respect to boom 152.

Figure 10:
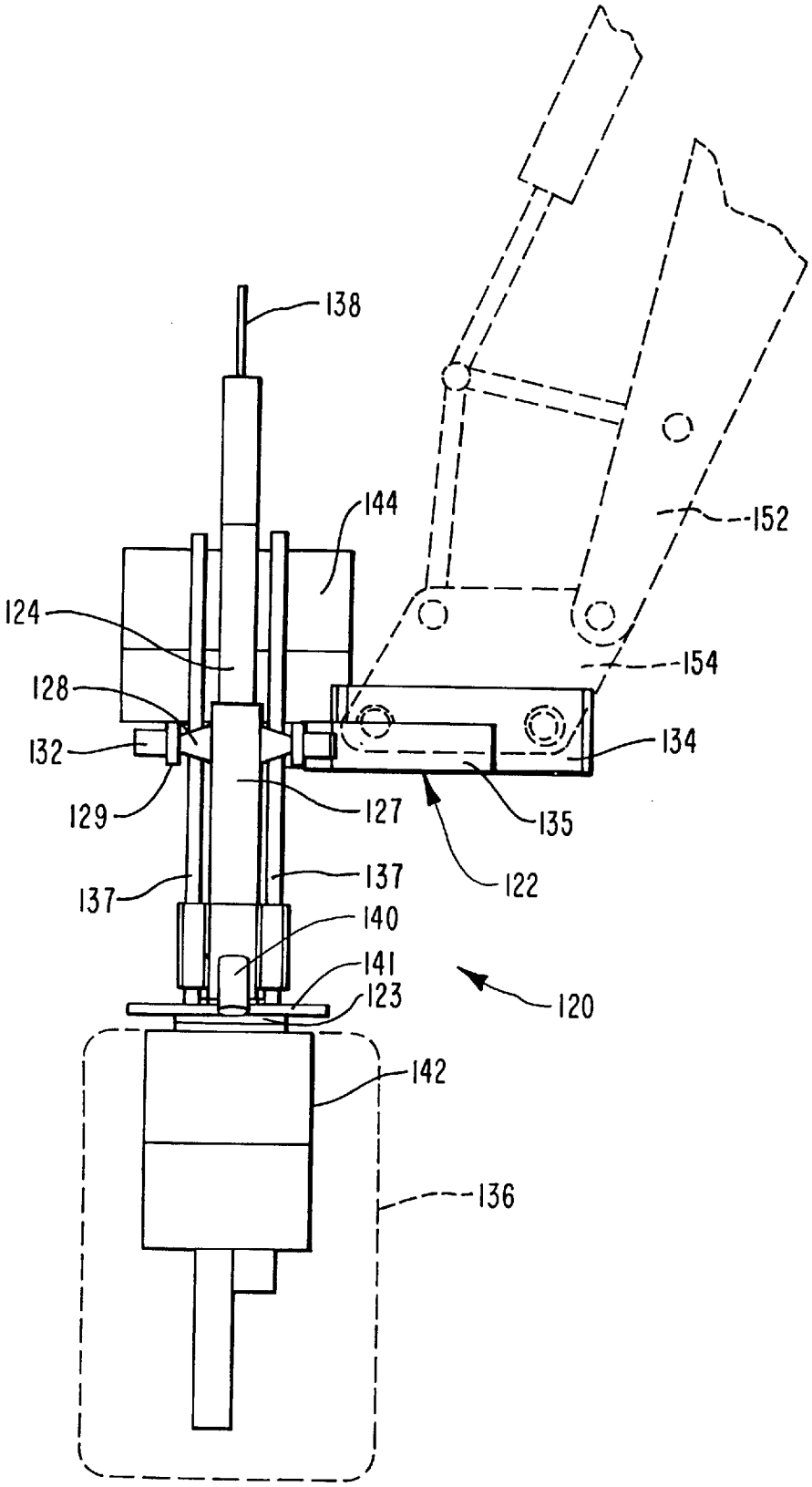
FIG. 10 is a side view of the second embodiment of the sensor apparatus of the invention, with a fully retracted mast.
Figure 11:
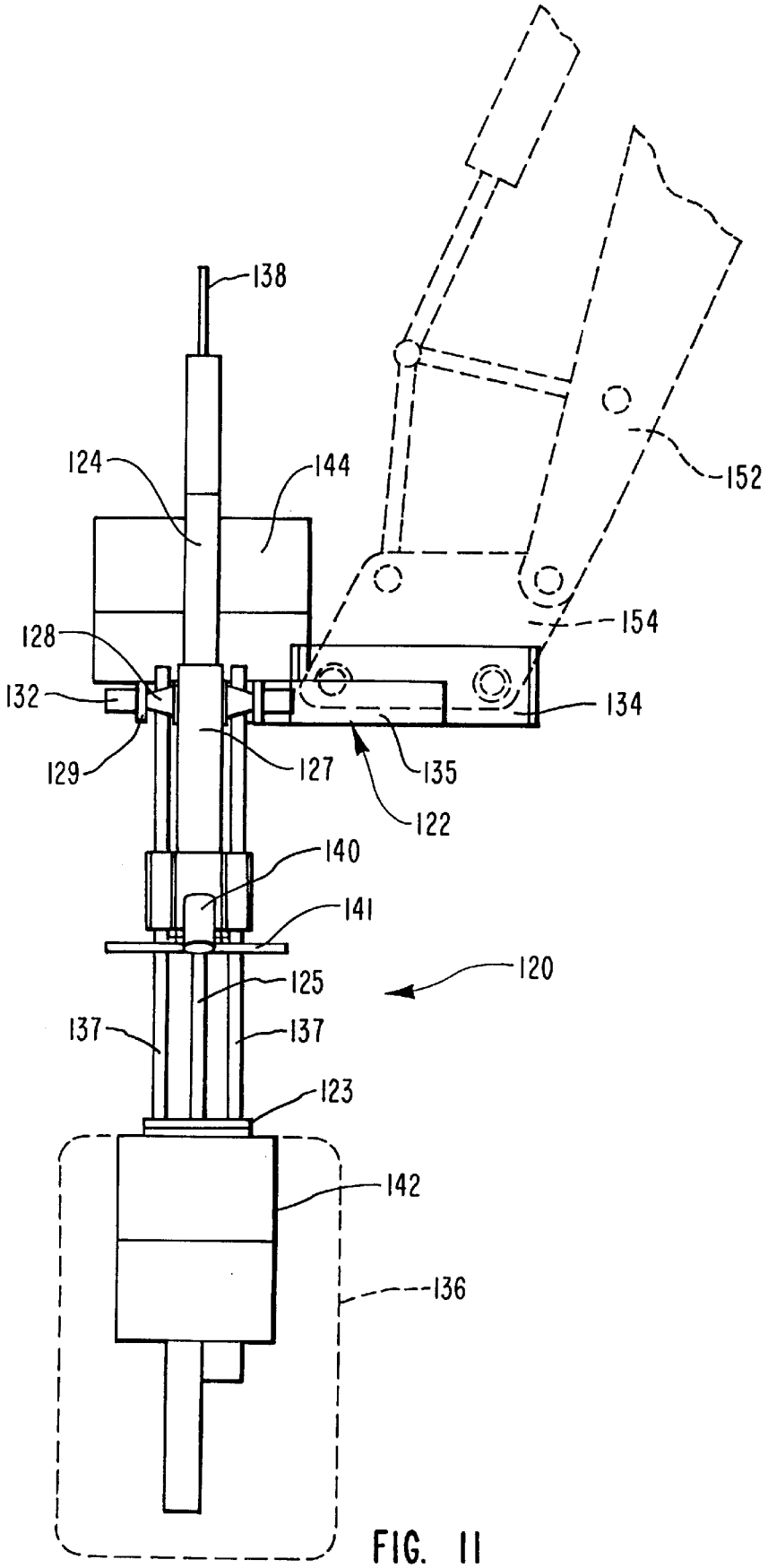
FIG. 11 is a side view of the sensor apparatus of FIG. 10, with a partially extended mast.

The sensor apparatus 120 also includes a means for vertically adjusting the elevation of the sensor over terrain. In the embodiment shown in FIGS. 10–13, such a vertically adjusting means for the sensor is in the form of an extendible mast 124 attached to platform assembly 122. The extendible mast 124 is partially surrounded by a mast housing 127 and has a moveable extension rod 125 as depicted in FIG. 11. FIG. 10 depicts sensor apparatus 120 with mast 124 in a retracted position, while FIG. 11 shows mast 124 in a partially extended position. In a preferred embodiment, extendible mast 124 is an electric linear actuator.

Figure 12:
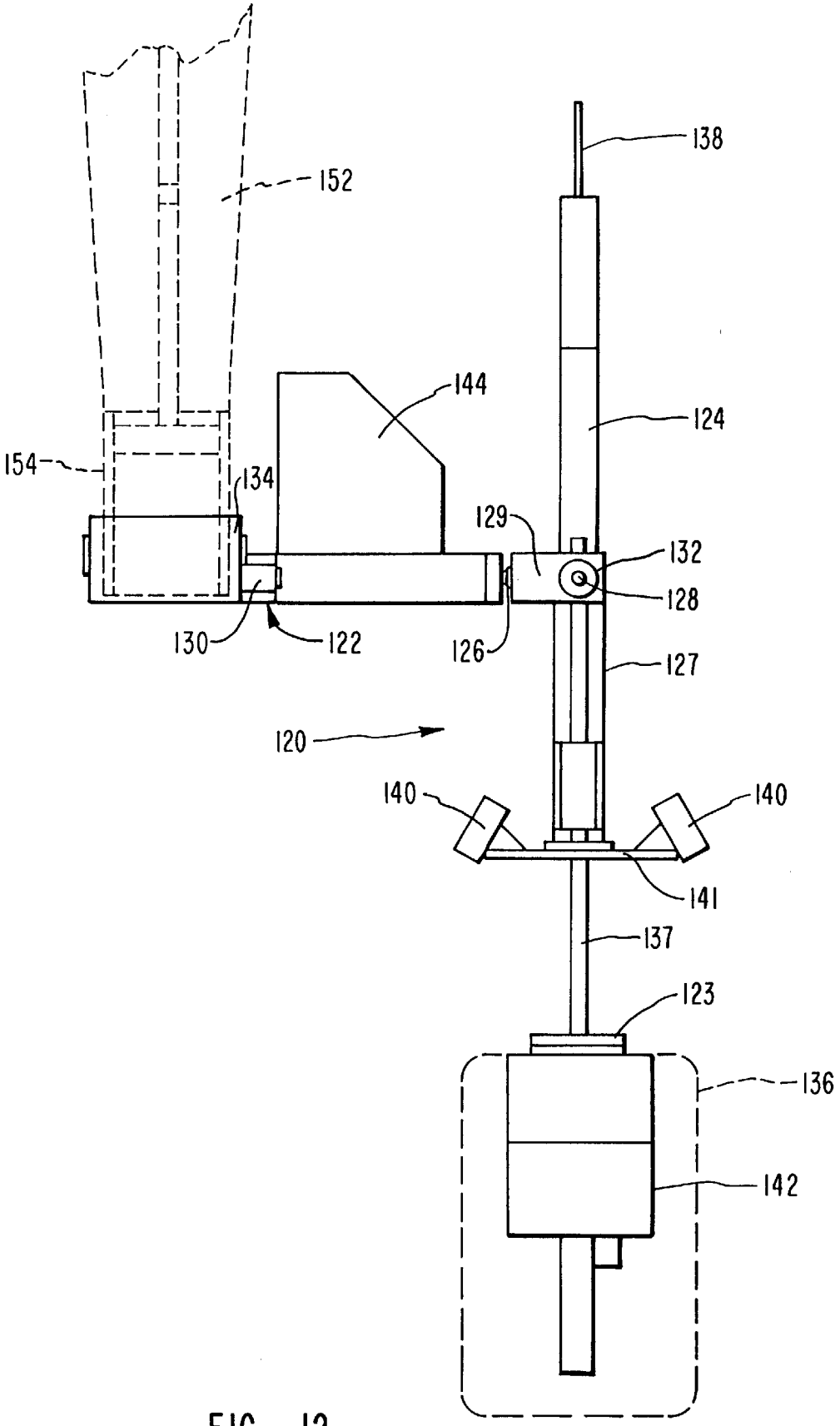
FIG. 12 is a front view of the sensor apparatus of FIG. 11.
Figure 13:
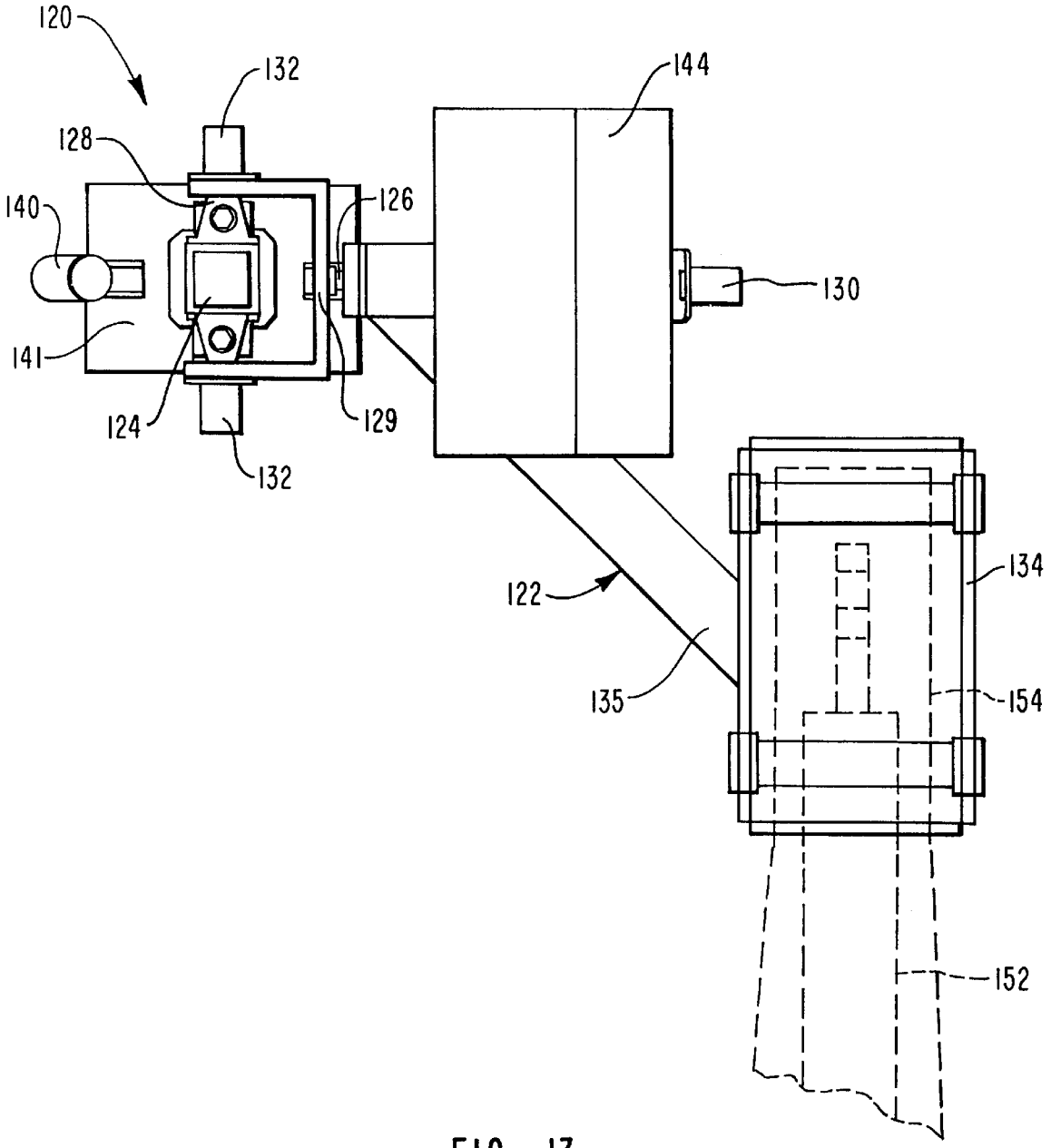
FIG. 13 is a top view of the sensor apparatus of FIG. 11.

An extendible sensor mount member 123 is attached to extension rod 125 of mast 124 as shown in FIG. 11. The sensor mount member 123 includes a pair of vertical stabilizing rods 137 that move up and down as extension rod 125 is moved. A sensor 142 is mounted on sensor mount member 123 within sensor mount area 136 such that sensor 142 moves up or down as extension rod 125 of mast 124 is retracted or extended. As shown in FIGS. 12 and 13, sensor apparatus 120 is preferably configured so as to be offset from boom 152 of an excavator. This prevents sensor apparatus 120 from hitting boom 152 while being deployed by the excavator.

The sensor apparatus 120 is designed such that mast 124 is maintained in a position close to vertical at all times in order to properly deploy the sensor. Thus, sensor apparatus 120 includes means for stabilizing the sensor against extraneous motions induced by manipulation of the mobile delivery device or other outside influences. In the embodiment depicted in FIGS. 10–13, such a stabilizing means for the sensor comprises a first yoke member 126 and a second yoke member 128 interconnected through a yoke linkage 129. The first yoke member 126 provides dampened rotation of sensor apparatus 120 about a first horizontal axis. The second yoke member 128 provides dampened rotation of sensor apparatus 120 about a second horizontal axis perpendicular to and in the same plane as the first horizontal axis. The yoke linkage 129 connecting first and second yoke members 126, 128 permits sensor apparatus 120 to rotate about two mutually perpendicular axes. Rotation about these axes under the influence of gravity allows mast 124 to passively seek vertical at all times. By having yoke members 126, 128 together in the same plane, the overall structure of sensor apparatus 120 can be shorter than the embodiment of FIGS. 3–5.

The rotation of sensor apparatus 120 about the platform axes can be controlled by a stabilization system to eliminate pendulum oscillations. The stabilization system can include either passive stabilizing devices or active stabilizing devices as discussed above in relation to the embodiment of FIGS. 3–5. As shown in FIGS. 10–13, a first stabilizing device 130 is operatively attached to first yoke member 126, and a second stabilizing device 132 is operatively attached to second yoke member 128. The stabilizing devices used with sensor apparatus 120 can be selected from various devices such as a linear damper, a rotational damper, a torsional damper, a pulsed braking device, a slip clutch device, a motor driven stabilizer, and various combinations thereof as discussed previously in relation to the embodiment of FIGS. 3–5.

An external positioning receiver 138 extends upwardly from mast 124 as depicted in FIGS. 10–12. The positioning receiver 138 is utilized in an external positioning system to measure world coordinates for at least one to three points on platform assembly 122 of sensor apparatus 120 at a rate of about one (1) to five (5) times per second. The external positioning system used with sensor apparatus 120 can be the same as that discussed above in relation to sensor apparatus 20 shown in FIGS. 3–5. Thus, either the GPS or the scanning laser positioning system, depicted in FIGS. 6 and 7 respectively, can be used in conjunction with sensor apparatus 120.

The sensor apparatus 120 also includes means for sensing terrain and providing sensor elevation control to maintain the sensor in close ground proximity. Such a terrain sensing means is provided by a terrain following system 140 disposed on a platform member 141 attached to a lower end of mast housing 127 as shown in FIGS. 10–13. The terrain following system 140 functions in the same manner as described above in relation to terrain following system 40 used in conjunction with sensor apparatus 20. Thus, as sensor apparatus 120 is arcuately displaced across the surface of a buried waste pit, the sensor will move up and down instantaneously in accordance with the terrain.

A data acquisition and control system 144 for sensor apparatus 120 is attached to platform assembly 122. The control system 144 has the same functions and operates in the same manner as described above in relation to control system 44 of sensor apparatus 20. Thus, control system 144 communicates with the sensor and is radio linked to the main remote workstation.

Virtually any type of sensor can be deployed from the sensor apparatus of the invention, which is designed to provide electric power to the sensor and receive an analog or digital sensor output. Preferably, a sensor suite is utilized in sensor apparatus 20. The sensor suite is selected to match the conditions of interest during a retrieval operation. These conditions may be of general interest at many sites (e.g., mapping solid waste boundaries, volatile chemical plumes, and radiation fields), or may be highly site-specific (e.g., tracking a mercury plume, or locating a specific object such as a reactor core).

A variety of sensors can be used in the present invention, including geophysical sensors, chemical sensors, radiological sensors, explosives sensors, or various combinations thereof. Non-limiting examples of sensors that can be used include a gamma/neutron mapper, a germanium gamma-ray spectrometer (Ge-spectrometer), a dielectric permittivity sensor, magnetometers, electromagnetic sensors such as electromagnetic induction sensors, and volatile gas sensors. These sensors can be utilized to detect a variety of materials and conditions. For example, magnetometers are useful in detecting ferrous metals, while induction sensors detect both ferrous and non-ferrous metals. The gamma/neutron mapper performs high sensitivity detection of low-level gamma-ray and neutron fields at relatively high speed, while the Ge-spectrometer identifies mixtures of radionucleides on a point-by-point basis.

The present invention has many advantages and benefits, including providing a versatile, economical system for making sensor measurements over irregular terrain with a minimum amount of permanent or semi-permanent infrastructure. The remote sensor apparatus of the invention has a near universal deployment capability because it relies upon standard excavation equipment for coarse delivery of the sensors over the entire area of interest. This avoids the need for custom motorized equipment since the system depends upon standard heavy equipment for primary motion. The deployment of the sensor apparatus by standard heavy equipment also provides the capability of working in rugged, hostile environments. The system of the invention is thus highly mobile and allows the sensor apparatus to be easily moved onto and off of the excavation site between excavation lifts. In addition, the sensor apparatus is not in the way during excavation, and can be used for evaluating excavation spoils or other excavation related purposes when not being deployed in an excavation pit.

Furthermore, the present invention provides a system for remotely deploying sensors in order to improve the safety and efficiency of hazardous waste retrieval or other excavation activities. The invention provides a portable apparatus that can control a variety of sensors in order to precisely measure, display, and record the location, intensity, and distribution of contaminants. Use of the sensor apparatus of the invention in a dig-face characterization operation reduces environmental, health, and safety risks during clean-up of buried waste sites, and is applicable to any waste site undergoing retrieval. In addition, the present invention permits real time monitoring of toxic waste and hazardous material concentrations in buried waste pits. Real time data interpretation during the retrieval process allows for the incorporation of appropriate remediation equipment to maintain safety and environmental standards.

Since the present invention is designed to minimize the time and cost required to collect data during excavation monitoring, the invention will strongly encourage an increase in the use of excavation monitoring in commercial operations. Although the present invention is particularly useful in the hazardous waste industry, the invention can be adapted for use in more conventional construction environments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A remotely controlled sensor apparatus suitable for deployment from a mobile delivery device, comprising:

(a) a sensor;

(b) a platform assembly having an extendible mast for vertically adjusting elevation of the sensor over terrain, said sensor attached to an extendible sensor mount member connected to said extendible mast;

(c) means for stabilizing the sensor against extraneous motions; and (d) means for sensing terrain and providing sensor elevation control to maintain the sensor in close ground proximity.

2. The apparatus of claim 1, wherein the sensor is selected from the group consisting of a geophysical sensor, a chemical sensor, a radiological sensor, an explosives sensor, and combinations thereof.

3. The apparatus of claim 1, wherein the sensor is selected from the group consisting of a magnetometer, an electromagnetic sensor, a gamma-ray spectrometer, a gamma/neutron mapper, a dielectric permittivity sensor, a volatile gas sensor, and combinations thereof.

4. The apparatus of claim 1, wherein the extendible mast is an electric linear actuator.

5. The apparatus of claim 1, wherein the means for stabilizing the sensor comprises a first yoke member providing dampened rotation about a first horizontal axis, and a second yoke member interconnected with the first yoke member and providing dampened rotation about a second horizontal axis perpendicular to the first horizontal axis.

6. The apparatus of claim 5, wherein the means for stabilizing the sensor further comprises a first stabilizing device operatively attached to the first yoke member, and a second stabilizing device operatively attached to the second yoke member.

7. The apparatus of claim 5, wherein the first and second stabilizing devices are selected from the group consisting of a linear damper, a rotational damper, a torsional damper, a pulsed braking device, a slip clutch device, a motor-driven stabilizer, and combinations thereof.

8. The apparatus of claim 1, further comprising an external positioning receiver extending from the apparatus.

9. The apparatus of claim 8, wherein the external positioning receiver is a global positioning receiver or a scanning laser receiver.

10. The apparatus of claim 1, further comprising means for coupling the platform assembly to a mobile delivery device.

11. The apparatus of claim 10, wherein the means for coupling the platform assembly comprises a quick-connect member protruding from the platform assembly.

12. The apparatus of claim 1, further comprising a data acquisition and control system attached to the platform assembly that operatively communicates with the sensor.

13. The apparatus of claim 1, wherein the apparatus is portable.

14. A remotely controlled sensor apparatus suitable for deployment from a mobile delivery device, comprising:

(a) a platform assembly;

(b) an extendible mast attached to the platform assembly;

(c) an extendible sensor mount member connected to the extendible mast;

(d) a sensor attached to the sensor mount member;

(e) means for stabilizing the sensor against extraneous motions induced by manipulation of a mobile delivery device;

(f) means for sensing terrain and providing sensor elevation control to maintain the sensor in close ground proximity;

(g) means for coupling the platform assembly to the mobile delivery device; and (h) an external positioning receiver extending from the apparatus.

15. The apparatus of claim 14, wherein the sensor is selected from the group consisting of a geophysical sensor, a chemical sensor, a radiological sensor, an explosives sensor, and combinations thereof.

16. The apparatus of claim 14, wherein the sensor is selected from the group consisting of a magnetometer, an electromagnetic sensor, a gamma-ray spectrometer, a gamma/neutron mapper, a dielectric permittivity sensor, a volatile gas sensor, and combinations thereof.

17. The apparatus of claim 14, wherein the extendible mast is an electric linear actuator.

18. The apparatus of claim 14, wherein the means for stabilizing the sensor comprises a first yoke member providing dampened rotation about a first horizontal axis, and a second yoke member interconnected with the first yoke member and providing dampened rotation about a second horizontal axis perpendicular to the first horizontal axis.

19. The apparatus of claim 18, wherein the means for stabilizing the sensor further comprises a first stabilizing device operatively attached to the first yoke member, and a second stabilizing device operatively attached to the second yoke member.

20. The apparatus of claim 19, wherein the first and second stabilizing devices are selected from the group consisting of a linear damper, a rotational damper, a torsional damper, a pulsed braking device, a slip clutch device, a motor-driven stabilizer, and combinations thereof.

21. The apparatus of claim 14, wherein the means for coupling the platform assembly comprises a quick-connect member protruding from the platform assembly.

22. The apparatus of claim 14, further comprising a data acquisition and control system attached to the platform assembly that operatively communicates with the sensor.

23. The apparatus of claim 14, wherein the external positioning receiver is a global positioning receiver or a scanning laser receiver.

24. The apparatus of claim 14, wherein the apparatus is portable.

25. A system for deploying a remotely controlled sensor apparatus used in a dig-face characterization operation, comprising:

(a) a mobile delivery device; and (b) a sensor apparatus detachably coupled to the mobile delivery device, the sensor apparatus comprising:

(i) a platform assembly;

(ii) an electric linear actuator suspended from the platform assembly;

(iii) a sensor attached to the electric linear actuator;

(iv) means for stabilizing the sensor against extraneous motions induced by manipulation of the mobile delivery device; and (v) means for sensing terrain and providing sensor elevation control to maintain the sensor in close ground proximity.

26. The system of claim 25, wherein the sensor is selected from the group consisting of a geophysical sensor, a chemical sensor, a radiological sensor, an explosives sensor, and combinations thereof.

27. The system of claim 25, wherein the sensor is selected from the group consisting of a magnetometer, an electromagnetic sensor, a gamma-ray spectrometer, a gamma/neutron mapper, a dielectric permittivity sensor, a volatile gas sensor, and combinations thereof.

28. The system of claim 25, further comprising an external positioning receiver extending from the sensor apparatus.

29. The system of claim 28, wherein the external positioning receiver is a global positioning receiver or a scanning laser receiver.

30. The system of claim 25, wherein the sensor apparatus is rigidly coupled to the mobile delivery device.

31. The system of claim 25, wherein the sensor apparatus is coupled to the mobile delivery device by a quick-connect member protruding from the platform assembly and engaging a complimentary coupling member on a boom of the mobile delivery device.

32. The system of claim 25, further comprising a data acquisition and control system attached to the platform assembly that operatively communicates with the sensor.

33. The system of claim 25, wherein the mobile delivery device is an excavator.

34. The system of claim 33, wherein the excavator is selected from the group consisting of a backhoe, a crane, and a power shovel.

35. A system for deploying a remotely controlled sensor apparatus in a dig-face characterization operation, comprising:

(a) a mobile delivery device;

(b) a sensor apparatus detachably coupled to the mobile delivery device, the sensor apparatus comprising:

(i) a platform assembly;

(ii) an extendible mast suspended from the platform assembly;

(iii) a sensor attached to the extendible mast;

(iv) means for stabilizing the sensor against extraneous motions induced by manipulation of the mobile delivery device, the means for stabilizing the sensor comprising a first yoke member providing dampened rotation of the platform assembly about a first horizontal axis, a second yoke member interconnected with the first yoke member and providing a dampened rotation of the platform assembly about a second horizontal axis perpendicular to the first horizontal axis; and (v) means for sensing terrain and providing sensor elevation control to maintain the sensor in close ground proximity.

36. The system of claim 35, wherein the means for stabilizing the sensor further comprises a first stabilizing device operatively attached to the first yoke member, and a second stabilizing device operatively attached to the second yoke member.

37. The system of claim 36, wherein the first and second stabilizing devices are selected from the group consisting of a linear damper, a rotational damper, a torsional damper, a pulsed braking device, a slip clutch device, a motor-driven stabilizer, and combinations thereof.

38. A method for deploying a remotely controlled sensor apparatus in a dig-face characterization operation, comprising the steps of:

(a) providing a mobile delivery device;

(b) coupling a sensor apparatus to the mobile delivery device, the sensor apparatus comprising:

(i) a sensor;

(ii) a platform assembly having an extendible mast for vertically adjusting elevation of the sensor over terrain, said sensor attached to an extendible sensor mount member connected to said extendable mast;

(iii) means for stabilizing the sensor against extraneous motions; and (iv) means for sensing terrain and providing sensor elevation control to maintain the sensor in close ground proximity, (c) positioning the mobile delivery device in a predetermined location; and (d) scanning the predetermined location with the sensor.

39. The method of claim 38, wherein the step of scanning with the sensor is accomplished by swinging the sensor back and forth through a series of concentric arcs.

40. The method of claim 38, further comprising the steps of relaying data from a sensor scan area to a workstation computer, and displaying real time information on subsurface conditions within the scan area.

41. The method of claim 38, wherein the sensor is selected from the group consisting of a geophysical sensor, a chemical sensor, a radiological sensor, an explosives sensor, and combinations thereof.

42. The method of claim 38, further comprising an external positioning receiver extending from the sensor apparatus.

43. The method of claim 42, wherein the external positioning receiver is a global positioning receiver or a scanning laser receiver.

44. The method of claim 38, wherein the sensor apparatus is rigidly coupled to the mobile delivery device.

45. The method of claim 38, wherein the sensor apparatus is detachably coupled to the mobile delivery device by a quick-connect member protruding from the platform assembly and engaging a complimentary coupling member on a boom of the mobile delivery device.

46. The method of claim 38, wherein the sensor apparatus further comprises a data acquisition and control system attached to the platform assembly that operatively communicates with the sensor.

47. The method of claim 38, wherein the mobile delivery device is an excavator.

48. The method of claim 47, wherein the excavator is selected from the group consisting of a backhoe, a crane, and a power shovel.

49. The method of claim 38, wherein the means for vertically adjusting elevation of the sensor is selected from the group consisting of an extendible mast, and a robotic arm.

50. The method of claim 38, wherein the sensor apparatus is portable.

51. A method for providing sensor elevation control to maintain a sensor in close ground proximity, comprising the steps of:

moving a sensor at a known speed across uneven terrain in a predetermined path divided into a series of segments, each said segment having a known starting point and an ending point;

mapping terrain topography around the ssenso substantially continuously to determine a target elevation for the sensor to achieve when the sensor reaches each said ending point; and adjusting the height of the sensor at a rate requred to achieve the target elevation by each said ending point to maintaim a substantially constant terrain clearance as the sensor is moved.

52. The method of claim 51, wherein the sensor is selected from the group consisting of a geophysical sensor, a chemical sensor, a radiological sensor, an explosives sensor, and combinations thereof.

mapping terrain topography around the sensor substantially continuously to determine a target elevation for the sensor to achieve when the sensor reaches each said ending point; and adjusting the height of the sensor at a rate required to achieve the target elevation by each said ending point to maintain a substantially constant terrain clearance as the sensor is moved.

53. The method of claim 51, wherein the step of moving the sensor at the known speed across uneven terrain in the predetermined path further comprises the step of measuring a position and/or the speed for the sensor at predetermined time intervals, each said position corresponding to one of said ending points.

54. The method of claim 51, wherein the step of adjusting the height of the sensor further comprises the step of raising or lowering a mast attached to the sensor in substantially vertical manner.

* * * * *